US008460796B2

(12) United States Patent
Sherman

(10) Patent No.: US 8,460,796 B2
(45) Date of Patent: Jun. 11, 2013

(54) COATINGS, COMPOSITION, AND METHOD RELATED TO NON-SPALLING LOW DENSITY HARDFACE COATINGS

(75) Inventor: Andrew J. Sherman, Kirtland Hills, OH (US)

(73) Assignee: Mesocoat, Inc., Euclid, OH (US)

( * ) Notice: Subject to any disclaimer, the term of this patent is extended or adjusted under 35 U.S.C. 154(b) by 112 days.

(21) Appl. No.: 12/699,779

(22) Filed: Feb. 3, 2010

(65) Prior Publication Data

US 2010/0203255 A1 Aug. 12, 2010

Related U.S. Application Data

(60) Provisional application No. 61/149,680, filed on Feb. 3, 2009.

(51) Int. Cl.

| | |
|---|---|
| ***B32B 3/00*** | (2006.01) |
| ***B32B 5/16*** | (2006.01) |
| ***B32B 7/00*** | (2006.01) |
| ***B32B 9/00*** | (2006.01) |
| ***B32B 13/04*** | (2006.01) |
| ***B32B 15/04*** | (2006.01) |
| ***B32B 19/00*** | (2006.01) |
| ***B05D 1/08*** | (2006.01) |
| ***C23C 4/00*** | (2006.01) |
| ***H05H 1/26*** | (2006.01) |
| ***C23C 4/04*** | (2006.01) |
| ***C23C 4/08*** | (2006.01) |

(52) U.S. Cl.

USPC ..... 428/472; 428/206; 428/446; 428/469; 428/697; 428/698; 428/701; 428/702; 427/446; 427/452; 427/453; 427/454; 427/455

(58) Field of Classification Search

USPC ..... 427/446, 452, 453, 454, 455; 428/206, 428/446, 469, 472, 697, 698, 701, 702

See application file for complete search history.

(56) References Cited

U.S. PATENT DOCUMENTS

| | | | | |
|---|---|---|---|---|
| 7,635,515 | B1 * | 12/2009 | Sherman | 428/325 |
| 7,681,622 | B2 * | 3/2010 | Sherman | 164/46 |
| 2007/0141270 | A1 | 6/2007 | Sherman | |

FOREIGN PATENT DOCUMENTS

| | | | |
|---|---|---|---|
| EP | 1548153 | A2 | 6/2005 |
| JP | 2000336468 | A | 12/2000 |
| JP | 2008069377 | A | 3/2008 |
| KR | 100219930 | B1 | 9/1999 |

* cited by examiner

*Primary Examiner* — Jonathan Langman

(74) *Attorney, Agent, or Firm* — Bruce A. Jagger

(57) ABSTRACT

A composite body that is spall resistant and comprises a substantially discontinuous cermet phase in a substantially continuous metal rich matrix phase. The composite body is typically bonded to a substrate to form a hardfacing on the substrate. The composite body exhibits ductile phase toughening with a strain to failure of at least about 2 percent, a modulus of elasticity of less than about 46 million pounds per square inch, and a density of less than about 7 grams per cubic centimeter. The metal rich matrix phase between the ceramic rich regions in the composite body has an average minimum span of about 0.5 to 8 microns to allow ductility in the composite body. The composite body has a Vicker's hardness number of greater than approximately 650. The discontinuous cermet phase is in the form of ceramic rich regions embedded within the composite body, and it includes ceramic particles and a cermet binder. The ceramic particles having a Moh's hardness of at least approximately 7.5, a modulus of elasticity of less than approximately 46 million pounds per square inch, and an average particle size of from about 0.1 to 10 microns. The ceramic rich regions exhibit high hardness as compared with the matrix phase.

2 Claims, 3 Drawing Sheets

Fig. 3
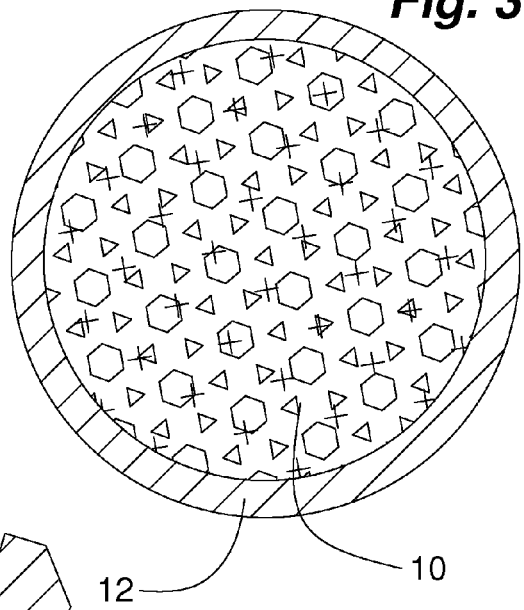
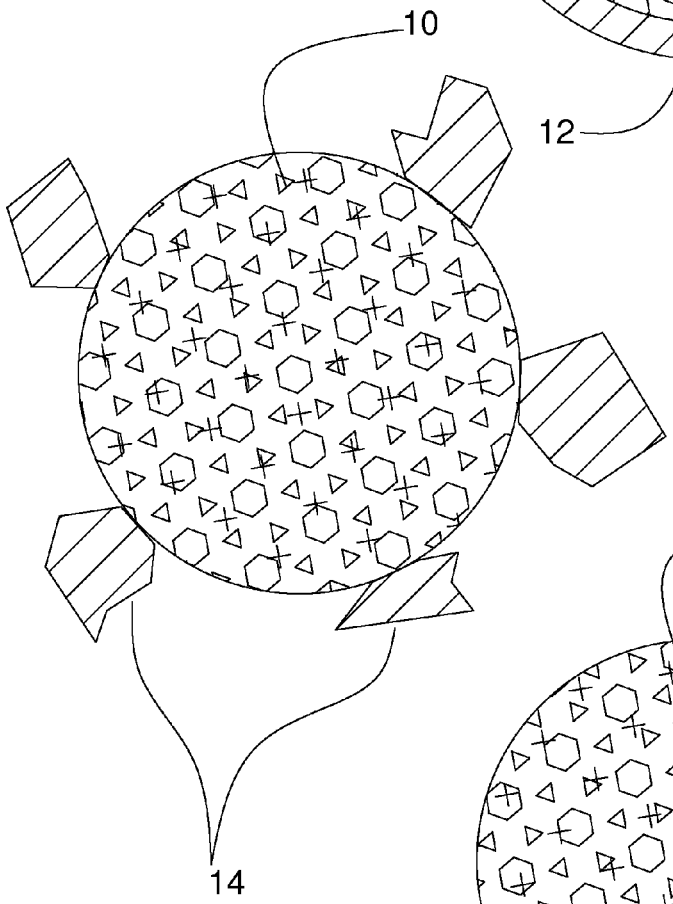
Fig. 4
Fig. 2
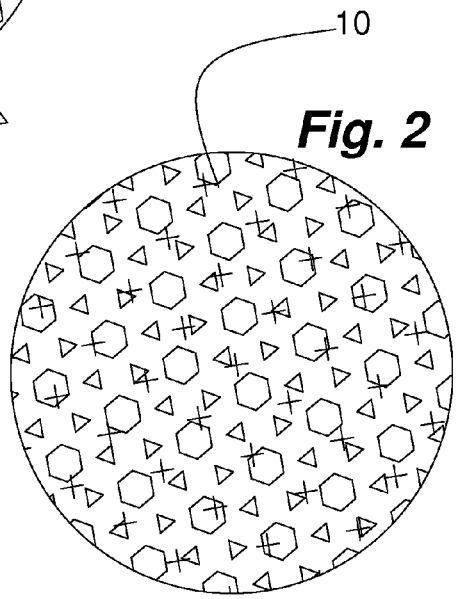

COATINGS, COMPOSITION, AND METHOD RELATED TO NON-SPALLING LOW DENSITY HARDFACE COATINGS

RELATED APPLICATIONS

This application claims the benefit of U.S. Provisional Application No. 61/149,680, filed Feb. 3, 2009.

This invention was made with government support under contract #EPA EP-D-06-053, microcomposite coatings for chrome replacement, awarded by Environmental Protection Agency at 1025 F St, Washington D.C., and subcontract #USAF-0040-SC-0024-1 under GDIT prime contract # FA8601-04-F-0040, awarded by the United States Air Force at Oklahoma City, OK.

BACKGROUND OF THE INVENTION

1. Field of the Invention

The invention relates in general to hardface coatings, compositions and methods, and, more particularly, embodiments of the present invention relate to hardface coatings, compositions, and methods that relate to spall resistant, low density hardface coatings.

2. Description of the Prior Art

Hardface coatings, particularly chromium and tungsten based coatings formed by the thermal spraying of composite powders are well known, but they are generally prone to spalling, and they are heavy. Thermally sprayed tungsten carbide-cobalt coatings, for example, are very hard, brittle and dense. The formation of coatings by thermal spraying ceramics such as ceramic nitrides had been proposed, but ceramics generally decompose instead of melting. For example, ceramic nitrides decompose at about 1900 degrees centigrade. Thermal spraying operations are typically carried out at temperatures well in excess of 1900 degrees centigrade, so attempts to form coatings by thermal spraying ceramic nitrides had generally been unsuccessful. The application of ceramic nitrides via physical vapor deposition and chemical vapor deposition operations for forming coatings that control wear and friction had been previously proposed, but such vapor deposition operations tended to be slow and expensive.

Previous attempts to improve wear had typically involved making harder and stiffer coatings at the expense of ductility. In general, as the coatings became harder and stiffer, the occurrence of spalling increased.

Prior thermal spray operations for forming hardface coatings typically had as an objective the melting of at least the sprayed material, and often also the surface of the substrate. Thorough melting of the sprayed powder was generally believed to be beneficial and necessary because it improved the prospects for the formation of a metallurgical bond, as distinct from a mechanical bond, between the coating and the substrate. This thorough melting generally resulted in the composition of the coating being more or less uniform throughout. Typical prior thermal spray operations include, for example, HVOF (high velocity oxy-fuel), laser forming, plasma spray, plasma transferred arc, and the like.

Unfortunately, these thermally sprayed coatings, which because of having high hardness, are brittle and are subject to spelling and catastrophic failure when subjected to impacts, point loading, or other high stress situations such as those that exist in landing gear cylinders used in carrier based aircraft. This spallation is caused by intensifying the stress in the high modulus coating, combined with its low strain tolerance. Furthermore, these coatings are very dense, ranging from about 8 grams per cubic centimeter for chrome carbide nickel chrome, and about 16 grams per cubic centimeter for tungsten carbide cobalt coatings. These higher density coatings add substantial weight, have low throughput through HVOF gun systems, and impose significant penalties in fuel economy and payload for aircraft and other transportation systems. Finally, these extremely hard coatings with limited ductility must be diamond super finished to prevent excessive seal wear and eliminate surface flaws that cause early failure. Due to their brittleness and high modulus, they are extremely sensitive to flaws and defects on the surface, and in the coating, meaning they are very difficult to apply, limiting their utility and the number of qualified applicators.

High stress and wear aerospace applications such as aircraft landing gear require a hardface coating on structural elements. Many such applications had previously involved the use of WC—Co coated high strength steels. It has been proposed to replace such high strength steels with titanium alloys, because of the weight savings that could be realized. The titanium alloys have a modulus of elasticity that is less than the previous high strength steels. The previous WC—Co coatings have been found to spall off of the titanium as it flexes. A hardface coating that has a modulus of elasticity low enough to not spall off of titanium is needed. For purposes of weight reduction structural members with thin cross-sections had been proposed. Such structural members tended to flex and deform. This resulted in spalling of the hardface coatings. Again a ductile hardface coating was needed. The formation of a ductile hardface coating previously appeared to be unachievable. Hardness and ductility were generally believed to be unachievable in the same coating.

The use of thermal spray operations to form heterogeneous coatings in which isolated high ceramic content regions are embedded within a ductile matrix is disclosed in Sherman published U.S. application No. 2007/0141270, published Jun. 21, 2007, which is hereby incorporated herein by reference as though fully set forth hereat.

Those concerned with these problems recognize the need for an improved hardface coating.

BRIEF SUMMARY OF THE INVENTION

The present invention has been developed in response to the current state of the art, and in particular, in response to these and other problems and needs that have not been fully or completely solved by currently available expedients. Thus, it is an overall object of the present invention to effectively resolve at least the problems and shortcomings identified herein. Embodiments of the present invention are particularly suitable for use as hardfacings in aerospace structural elements where ruggedness, reliability, durability, and low density are significant factors for functionality and safety.

An embodiment of the present invention comprises a heterogeneous composite body that is spall resistant and comprises a substantially discontinuous cermet phase in a substantially continuous metal rich matrix phase.

Although capable of standing alone without a substrate, in certain embodiments, the composite body is bonded to a substrate such as, for example, steel, titanium, aluminum, or their alloys, particularly their high strength alloys. Such substrates are typically metals that require a hardfacing for purposes of wear, ruggedness, corrosion resistance, and durability.

The composite body exhibits ductile phase toughening with a strain to failure of at least about 2 percent, a modulus of elasticity of less than about 46 million pounds per square inch, and a density in some embodiments of less than about 7 grams per cubic centimeter, and in further embodiments, less than about 6 grams per cubic centimeter. The metal rich matrix phase between the ceramic rich regions in the composite body has an average span of about 0.5 to 10 microns to allow ductility in the composite body. The composite body has a Vicker's hardness number (VHN) of greater than approximately 650 in some embodiments, and greater than approximately 750 in further embodiments, up to approximately 1200 VHN.

The discontinuous cermet phase is in the form of a ceramic rich regions embedded within the composite body, and includes ceramic particles and a cermet binder. The ceramic particles having a Moh's hardness of at least approximately 7.5, and in certain embodiments of from about 8 or 9, a modulus of elasticity of less than approximately 46, and in some embodiments of less than approximately 40 million pounds per square inch, and an average particle size of from about 0.1 to 10 microns. The ceramic rich regions exhibit high hardness as compared with the matrix phase.

According to certain embodiments, the heterogeneous composite bodies are prepared by agglomerating fine ceramic particles and thoroughly dispersed cermet binder into core cermet particles. The core cermet particles are then combined with metal rich matrix forming materials into a composite body. The combining operation may be performed by a conventional thermal spraying operation, a conventional electrolytic deposition process, or the like. Where thermal spraying is employed to form the composite body, the core cermet particles are combined with the metal rich matrix forming materials into a feedstock for the thermal spraying operation. The thermal spraying operation may be conducted, for example, according to the teachings of Sherman published U.S. application No. 2007/0141270. HVOF thermal spraying processes have been found to be particularly suited to the production of certain embodiments of the present invention. When conventional electrolytic deposition procedures are employed, the core cermet particles may just be dispersed in the bath so they become entrapped in the coating as it forms.

To acquaint persons skilled in the pertinent arts most closely related to the present invention, an embodiment of a composite body that illustrates a best mode now contemplated for putting the invention into practice is described herein by, and with reference to, the annexed drawings that form a part of the specification. The exemplary embodiment is described in detail without attempting to show all of the various forms and modifications in which the invention might be embodied. As such, the embodiments shown and described herein are illustrative, and as will become apparent to those skilled in the arts, can be modified in numerous ways within the scope and spirit of the invention, the invention being measured by the appended claims and not by the details of the specification or drawings.

BRIEF DESCRIPTION OF THE DRAWINGS

The present invention provides its benefits across a broad spectrum of hardface applications, including aerospace, mining, oil, and gas exploration and development, equipment repair, farming and construction equipment, and the like. While the description which follows hereinafter is meant to be representative of a number of such applications, it is not exhaustive. As those skilled in the art will recognize, the basic compositions, composite bodies, and methods taught herein can be readily adapted to many uses. This specification and the claims appended hereto should be accorded a breadth in keeping with the scope and spirit of the invention being disclosed despite what might appear to be limiting language imposed by the requirements of referring to the specific examples disclosed.

Referring particularly to the drawings for the purposes of illustrating the invention and its presently understood best mode only and not limitation:

FIG. 2 diagrammatically depicts an embodiment of an agglomerated core cermet particle according to the present invention.

FIG. 3 diagrammatically depicts an embodiment of a coated cermet particle adapted for use as feedstock in a thermal spray operation, according to the present invention.

FIG. 4 is diagrammatically depicts an additional embodiment of a core cermet particle and associated matrix forming metal rich particles adapted for use as feedstock in a thermal spray operation, according to the present invention.

DETAILED DESCRIPTION OF THE PREFERRED EMBODIMENTS

Figure 1:
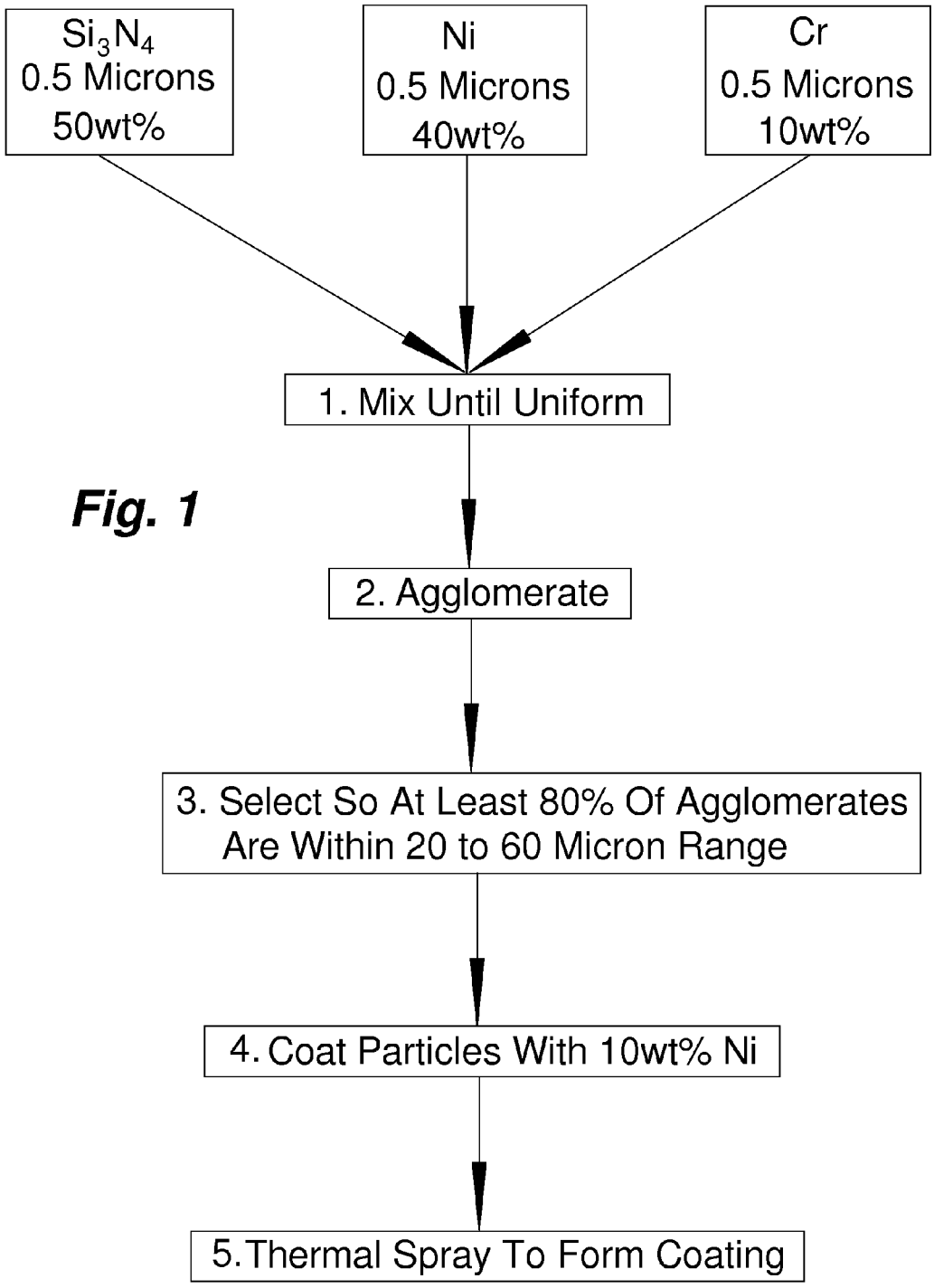
FIG. 1 depicts a flow chart of one embodiment for producing heterogeneous composite bodies according to the present invention.

Referring now to the drawings wherein like reference numerals designate identical or corresponding parts throughout the several views. It is to be understood that the drawings are diagrammatic and schematic representations of various embodiments of the invention, and are not to be construed as limiting the invention in any way. The use of words and phrases herein with reference to specific embodiments is not intended to limit the meanings of such words and phrases to those specific embodiments. Words and phrases herein are intended to have their ordinary meanings in the art, unless a specific definition is set forth at length herein.

Referring particularly to the drawings, in the embodiments chosen for the purposes of illustration, there is illustrated generally at 10 a core cermet particle comprised of an agglomerated intimate mixture of ceramic particles and a cermet binder. The core cermet particle in the embodiment of FIG. 3 is encapsulated within a substantially continuous coating of a metal rich matrix forming material 12. In the embodiment of FIG. 4, particles of metal rich matrix forming material, of which 14 are typical, are associated with core cermet particle 10 by being adhered to the core cermet particle in a discontinuous coating.

Figure 5:
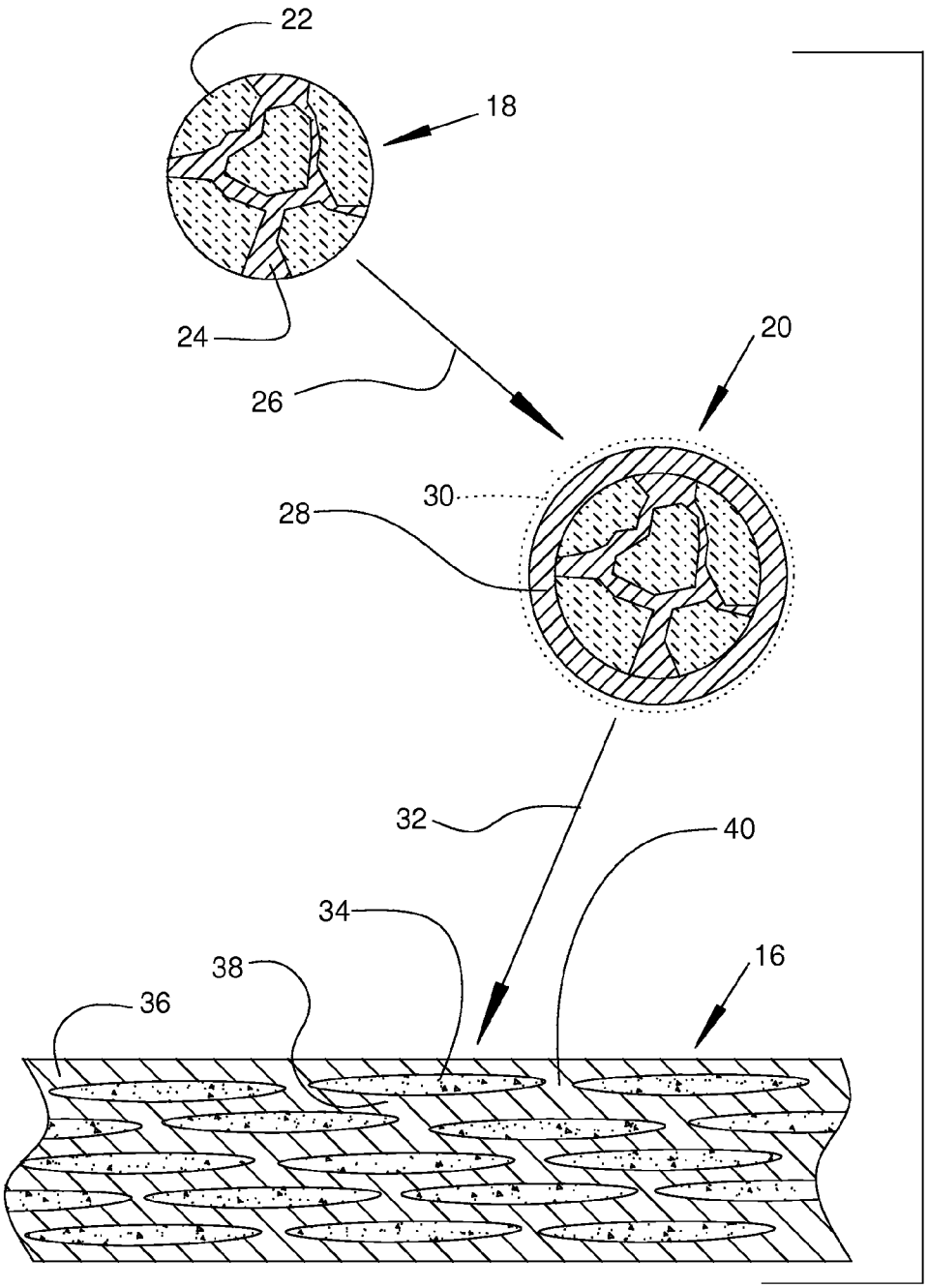
FIG. 5 diagrammatic depicts an embodiment of a process of forming a heterogeneous composite body according to the present invention.

In the embodiment of FIG. 5, a composite body 16 is formed by selecting an agglomerated and consolidated core cermet particle 18, coating it in coating step 26, to form a substantially continuously coated cermet particle 20 that is substantially encapsulated within metal rich matrix forming material 28. Coated cermet particle 20 is supplied as the feedstock for a thermal spraying step 32. The softened coated cermet particle 20 impinges on a substrate (not shown) to form the composite body 16. Substantially continuously coated cermet particle 20 deforms to form a discontinuous cermet phase in composite body 16. The discontinuous cermet phase, in the embodiment chosen for illustration, comprises ceramic rich regions 34 generally in the form of lenticular shaped deposits embedded within and generally spaced from one another by a substantially continuous metal rich matrix phase 36. The ceramic rich regions 34 are generally formed from the deformed core cermet particles 18, while the metal rich matrix phase 36 is generally formed from the metal rich matrix forming material 28. Additives 30 may be included at any stage in the formation of the cermet particle. Such additives are indicated generally at 30. Such additives generally conventional, and they are included for beneficially modifying the behavior or properties of the cermet particle. The ceramic rich regions are generally spaced apart by a span, as indicated generally at 38 and 40. The span is irregular in shape and size but exhibits an average distance that is largely dictated by the proportioning of the metal rich matrix forming material 28 to the coated cermet particle 20. The spans are substantially filled with the continuous metal rich matrix phase 36. Replacing the substantially continuous coated cermet particle 20 with a discontinuous coated cermet particle as illustrated in FIG. 4 provides substantially the same composite body 16. The use of particles of loose metal rich matrix forming material (not illustrated) results in substantially the same composite body 16, provided that the feedstock is very thoroughly mixed so as to form a loose discontinuous coating around the core cermet particle.

According to certain embodiments, the composite body has a strain to failure of from more than 1, and in certain embodiments, about 2 to 6 percent and a modulus of from approximately 46 to 20, or 40 to 25 million pounds per square inch. In some embodiments, the metal rich matrix phase has an average span between the cermet regions of the discontinuous cermet phase of about 0.5 to 10 microns, and in some additional embodiments, a minimum span of about 0.4 or 0.5, up to a maximum of about 8 microns, and in some further embodiments a span of from about 0.5 to 2 microns.

The span of the metal matrix phase between the cermet regions has been found to contribute substantially to the ductility of the composite body. The span of metal rich matrix is in the nature of a ductile phase inclusion that has a minimum average dimension. The span must be sufficient to permit the metal rich matrix phase to work harden. A minimum span of approximately 0.4 to 0.5 microns has been found to be required to achieve proper ductility. If this span is too small, there is little or no work hardening, and the composite body tends to break under stress. If the average span is greater than it needs to be to permit work hardening (generally less than about 8, and in some embodiments about 6 or 5 or 2 or less microns), the hardness, density, and abrasion resistance of the composite body may not be sufficient for the intended uses. The amounts of cermet and metal rich matrix phase are proportioned in the composite body to achieve an optimum average span for a particular cermet-metal rich matrix composite. For certain embodiments the optimum proportions are determined by an initial calculated approximation (using the Rule of Mixtures) followed by an iterative process of actual testing.

The metal rich matrix phase comprises a ductile metal. The metal rich matrix phase extends between the ceramic rich regions that are formed from the cermet particles. Certain embodiments, for example, utilize as the ductile metal at least one of nickel and cobalt and their alloys; Ni—$Ni_3P$, NiP, $Ni_2P$; Ni—Cr; Fe—Cr—Al; Ni—Ni2B, Co—Co3P, Fe—Al alloys, Ni—Al alloys, titanium and its alloys, including Ni—Ti alloys, copper and its alloys, and mixtures and alloys of these. The metals rich matrix phase should have a modulus of less than approximately 42, and in some embodiments less than approximately 35 million pounds per square inch. The modulus exhibited by chrome is 42 million pounds per square inch. The metal in the metal rich matrix phase should melt below about 1900 degrees centigrade (the decomposition temperature of silicon nitride). The material in the metal rich matrix phase should not react significantly with the ceramic at the temperatures encountered in a thermal spraying operation.

The metal rich matrix forming material generally comprises from about 5 to 30V % of the feedstock from which the composite body is formed, and according to some embodiments, from about 5 or 10 or 15 to 20 or 25 or 30V %. The cermet particles that are used as feedstock in a thermal spraying operation are generally in the 10 to 60, and in some embodiments from 20 to 50 micron average particle size. The cermet particle size depends largely on the requirements of the particular spray gun that is used, and the thermal mass and density of the particular particles. In general, particle sizes below 10 microns tend to plug many spray guns, and particles above 60 microns tend to cause grit blasting of the substrate against which they are sprayed.

According to certain embodiments, the composite body has a density of less than about 6 grams per cubic centimeter. To achieve this, the amount of low density ceramic must be maximized while still achieving the desired strain to failure and modulus properties. Where the mode of application involves thermal spraying, and ceramic nitrides are involved, there is an additional consideration. There is a balance between the cermet binder and the ceramic nitride. Ceramic nitrides typically decompose instead of melting. For example, $Si_3N_4$ decomposes at about 1900 degrees centigrade. Thermal spraying systems typically operate at temperatures that are significantly above this decomposition temperature. Unprotected nitride ceramics decompose at the temperatures that are normally employed in thermal spraying operations. When the cermet binder is very thoroughly distributed in the cermet (for example, by coating the ceramic particles, or employing extended mixing times with cermet binder particles of approximately a micron in average diameter) less decomposition of the ceramic particles occurs. While not wishing to be bound by any theory, the thoroughly distributed cermet binder apparently tends to hold the gaseous decomposition products in intimate contact with the ceramic particles so the decomposition reaction is kinetically suppressed. There needs to be sufficient cermet binder and it must be thoroughly enough distributed to suppress the decomposition of the ceramic particles. According to some embodiments, less than approximately 20 percent of the ceramic nitrides decompose during thermal spraying. Without enough thoroughly distributed cermet binder in the cermet, the decomposition rate approaches 100 percent. For certain embodiments, the optimum proportions and mixing operations are determined for a particular ceramic-cermet binder combination by an initial calculated approximation (based on the Rule of Mixtures) followed by an iterative process of actual testing. According to certain embodiments, the ceramic particles comprises from about 30 to 80, or from about 40 to 70, or from about 40 to 50 volume percent of the agglomerated core cermet particles.

According to certain embodiments, the average particle sizes of the ceramic particles range from about 0.01 or lower to about 10 microns. In further embodiments the ceramic particle average sizes range from about 0.1 to 8 microns or 0.3 to 8 microns, and in additional embodiments from about 0.3 to 5 microns. With average ceramic particle sizes larger than from about 8 to 10 microns the resulting composite bodies tend to exhibit higher corrosion and wear rates than exhibited by composite bodies with ceramic particles below about 10 microns in size. The lower practical limit on ceramic particle size is imposed by processing limitations. Below about 0.1 microns it becomes difficult to produce consistent uniform cermets.

The ceramic particles, according to certain embodiments, are ceramics with a high hardness to stiffness ratio. That is, such ceramics have a high hardness and a low modulus.

Suitable ceramics with the necessary hardness and low modulus of elasticity include, for example, the nitrides, carbonitrides, and oxynitrides of silicon, titanium, chromium, vanadium, aluminum, zirconium, niobium, and mixtures thereof, zircon, zirconia, sapphire, and mullite. Alumina by itself has a modulus of about 48 to 50 million pounds per square inch, but it can be satisfactorily blended with other ceramics that have a lower modulus or it may be used in small volume fractions. Zircon has a modulus of about 21 million pounds per square inch, and zirconia has a modulus of about 35 million pounds per square inch. Mullite has a Moh's hardness of about 9 and a modulus of about 38 million pounds per square inch. In certain embodiments the ceramic particles comprise at least one of $Si_3N_4$, TiN, VN, $V_2N$, CrN, $Cr_2N$, ZrN, $Nb_2N$, TiCN, SiCN, SiON, or SiALON. Nitrides exhibit low friction and generally a high thermal compatability with metals.

The cermet binder in certain embodiments comprises metal particles having an average size of less than about 5 microns down to about 0.5 micron, and in further embodiments from about 2 to 0.5 microns. For the purposes of safety, the particle size of metallic cermet binders should be above that at which they become explosive when exposed to air. Suitable metals according to certain embodiments include, for example, Ni, Co, Fe, and their alloys with Cr, Al, and Ti, and mixtures thereof. In further embodiments the cermet binder is a metal coating on the ceramic particles. Such metal coatings are applied by conventional techniques, including, for example, chemical vapor deposition, vigorous mixing or milling under conditions where the metal is smeared onto the ceramic, or the like.

Spallation had become a significant problem for prior hardface coatings, particularly on high stress and thin section structural components. Spallation is a combination of modulus (the amount of stress built up for a given deflection), and ductility or strain tolerance. It is not just modulus, it is a combination of modulus and ductility or toughness, interlacing with adhesive strength. Ceramics generally have strain tolerance of less than 0.7 percent, combined with high modulus and generally poor adhesion. Previous hardfacing materials generally had high modulus, relatively poor strain tolerance ductility (WC—Co is about 0.5-0.8 percent). Composite bodies according to the present invention have low modulus, or little modulus mismatch with a substrate to which it is adhered (matched to steel in the ideal case where steel is used as a substrate), so there is little strain mismatch, good adhesion (above about 10,000 pounds per square inch), and very high toughness or strain tolerance (above 1 percent, and in most embodiments, above about 2 percent, and for some embodiments above about 3 percent). Strain tolerance means that defects work-harden and redirect strain away from a deformation zone, which is not generally a property enjoyed by prior hardface coatings. The following examples of the best mode presently contemplated for the practice of the present invention will illustrate the practice of the present invention and suggest additional embodiments to those skilled in the art.

EXAMPLE 1

An agglomerated microcomposite powder was prepared by ball milling 0.5 micron $Si_3N_4$ powders with 40 weight percent (wt %) Ni and 10 wt % Cr powder for 24 hours in a ball mill. This Example is diagrammatically illustrated in FIG. 1. A polyvinyl alcohol binder was added along with water and conventional surfactants to reduce the viscosity of the resulting slurry to between 200 and 300 centipoises. An agglomerated powder was formed by spray drying the slurry. The slurry was spray dried at 15,000 revolutions per minute using a centrifugal atomizer, a gas temperature of 300 degrees centigrade, and an exit temperature of 180 degrees Fahrenheit to create approximately spherical, free flowing agglomerated powders. These powders were debound at 200 to 300 degrees centigrade in hydrogen, and sintered for 2 hours at 1250 degrees centigrade to produce a densified, free flowing powder wherein approximately half of the particles had a diameter of approximately 38 microns. The powders were screened to produce a −270, +400 mesh cut. The screened powders were further coated with 10 wt % nickel using the decomposition of nickel carbonyl in a fluidized bed reactor. The nickel coated agglomerated powders were then sprayed onto a grit-blasted M300 steel substrate using a TAFA JP8000 thermal spray system (manufactured by the Tafa Division of Praxair) utilizing liquid kerosene as the fuel, and oxygen as the oxidizer gas. The resultant coating had a Vicker's hardness number (VHN) of about 720, an adhesive strength of greater than about 10,000 pounds per square inch gauge (pursuant to ASTM 622 bonded pin adhesion test). The coating had a 180 degree bend radius of less than about 0.5 inches, and a density of about 5.6 grams per cubic centimeter. In determining the bend radius a coupon was bent around a ½ inch diameter mandrel into a "U" shape without cracking or breaking the coating. This coating survived 180 KSI fatigue testing at R=−1.0 with no evidence of chipping or spallation. The fatigue testing was carried out on coated 4140 (M300) steel and measured using ASTM E 466. This uncoated steel has a 220 KSI fatigue limit. By comparison, WC—Co coatings typically spall at about 160 KSI. The Modulus of elasticity was calculated using the Rule of Mixtures to be about 35 million pounds per square inch. The strain to failure of the coating was estimated from the bend radius at cracking to be about 4 percent. This coating is suitable for replacing chrome and WC—Co hardfacings in repairing aircraft actuators and landing gear cylinders. Embodiments of coatings prepared according to this Example will exhibit residual stresses generally between approximately 5,000 pounds per square inch gauge (psig) compressive and approximately 3,000 psig tensile residual stresses, and in further embodiments, between approximately neutral tensile residual stress and approximately 2,000 psig compressive residual stress. Repetition of this Example will produce coatings that when having a thickness of about 5 to 7 mils on 4340 or 300M steel will withstand at least approximately 200 cycles at about 200 KSI to about 210 KSI fully reversed (R=−1) loading. Embodiments of such coatings will provide similar results when applied to other known ultra-high strength steels.

EXAMPLE 2

Titanium nitride powder having an average particle size of about 1 to 3 microns (manufactured by Kennametal inc) was mechanically alloyed with 32 wt % Ni and 8 wt % Cr powder (average particle size of about 1 to 5 microns) in a Segvari type attrition mill for 24 hours. The attrition mill was manufactured by Union Process. All powders were −325 mesh. The mechanically allowed powders were removed from the mill, dried, and then blended using a high shear mixer with a water-2 percent polyvinyl alcohol solution basified with $NH_3OH$ to produce about a 45 volume percent (V %) solids loaded slurry with a viscosity between 100 and 300 centipoises. The slurry was sprayed through a FU11 centrifugal atomizer (manufactured by NIRO) at 18,000 revolutions per minute to produce about 34 micron average particle size agglomerated powders. The spray dried agglomerated powders were debound at approximately 200 to 300 degrees centigrade in hydrogen. The debound agglomerated particles substantially retained their size as they were sintered at about 1200 degrees centigrade for about 3 hours to produce a substantially fully densified microcomposite core cermet. The agglomerated core material was further coated with 10 wt % nickel metal using the decomposition of a nickel salt (Nickel acetylacetate mono hydrate) in a fluidized bed at 350 degrees centigrade in the presence of oxygen. The microcomposite powders were then sprayed onto a 4340M high strength steel substrate which had been cleaned and grit blasted. The conditions of thermal spraying were such that the TiN partially decomposed yielding a Ti rich TiN with a calculated modulus of 42 million pounds per square inch (295 Gpa). The coating had a microhardness of 838 VHN, was extremely resistant to the acidic environments seen in acidic oil, had an estimated strain to failure of greater than about 3 to 4 percent (based on bend radius at cracking), had an adhesion exceeding 10,000 pounds per square inch gauge (ASTM 622), and a density of about 6.3 grams per cubic centimeter. The modulus of elasticity was calculated from the Rule of Mixtures to be about 41 million pounds per square inch. This TiN based coating is suitable for the coating of deep drilling components, including rods, bearings, pump shafts, seals, rotors, and valve bodies that see corrosive and erosive conditions.

EXAMPLE 3

A 0.3-0.8 micron alpha SiAlON powder (about 1.2 way in between $Al_2O_3$ and $Si_3N_4$) was prepared and blended with 40V % Ni—Cr binder. This blend was spray dried and sintered to form about a 35 micron diameter agglomerated core particle. This particle was then clad with 5 to 7V % of a Ni—$Ni_3P$ nanocomposite by conventional electroless plating. These powders were then sprayed using an high velocity oxy fuel (HVOF) thermal spray system, to produce a substantially fully dense coating, that exhibited a hardness of 800 to 950 VHN, and bend ductility between 3 and 5 percent as measured using an ASM bend ductility coupon. A $1/32^{nd}$ inch thick steel plate 6 inches long was thermally sprayed to form a 50 to 70 micron thick coating (2 TO 3 mils). This coupon was bent around a tapered mandrel with a diameter varying from 0.5 to 1 inch in diameter. The bend ductility is estimated from where cracks or striations are first observed. A 1 inch bend is approximately 3.5 percent ductility, and a 0.5 inch bend diameter is approximately 7 percent ductility. The coating on this coupon exhibited cracking at approximately 0.75 inch bend diameter. The modulus of elasticity was estimated from the Rule of Mixtures to be about 37 million pounds per square inch. The strain to failure was estimated from the bend radius at cracking to be about 4.5 percent. This coating can be finished using belt sanding or other rapid and low cost finishing techniques. These coatings are suitable for use as a replacement for WC—Co in applications not requiring the very high hardness (or the cost) of WC—Co, but which require higher wear and corrosion resistance than can be provided by hard chrome.

Previously, various additives and modifiers had been proposed for various purposes in forming and using different cermet products. Such additives include, for example, wetting agents, grain growth inhibitors, melting point adjustment agents, and the like. The inclusion of optional modifiers and additives to the cermet particles is indicated at 30 (FIG. 5). Modifiers and additives typically serve to promote adhesion, or limit grain growth, or limit diffusion or reaction, or otherwise modify melting temperatures, physical, mechanical, or chemical properties, or the like.

Particularly where thermal spraying is employed to form the composite body, all of the materials that go into the composite body are contained in the cermet powder. Thus, the composition and physical configuration of the composite body are at least primarily determined by the composition and configuration of the cermet particles, together with the conditions under which the body is formed.

The cermet binder may include reinforcing inclusions or dissolved materials that alter the physical or chemical properties of the cermet binder and/or the composite body. In general, the cermet binder is more than 50 volume percent ductile metal.

The metal rich metal matrix precursor from which the metal rich matrix phase in the composite body is formed generally contains more than half and in certain embodiments, more than approximately 75 volume percent ductile metal. The metal rich matrix precursor material may include reinforcing inclusions or dissolved materials that alter the physical or chemical properties of the metal rich matrix phase of the composite body.

The composite bodies according to the present invention are typically formed in situ on a surface of a substrate. That is, the composite body forms in place from a more or less fluid state as compared with being formed somewhere else, transferred to and applied to the surface of the substrate. Being formed in situ from an approximately fluid state causes the body to bond as tightly as possible to the substrate. Where the bonding is mechanical, the formed in situ composite body conforms in minute detail to the supporting surface in a way that is impossible to achieve with a separately formed body. The in situ forming permits the body to conform to arcuate or angular surfaces, or surfaces where anchoring configurations or roughness has been deliberately provided.

The composite body is conveniently formed on a flat, arcuate, or angular surface of a substrate. The substrate typically has physical characteristics that differ from those of the composite body. Typically, the substrate supports and lends strength to the composite body, and the body provides wear resistance and hardness to the substrate. Where the composite body is intended to be separated from the substrate, the substrate can be a low melting alloy or a material that can be removed by leaching without harming the composite body, or the like. Where metallurgical bonding is required, the surface of the substrate can be pre-coated with an adhesion promoter. Adhesion promoters include, for example, aluminum or other elements that form low melting alloys with the metal rich matrix. Where mechanical bonds are to be formed, the bonding surface of the substrate can be roughened or porous.

The metal rich matrix phase precursor that is associated with the cermet particle can be, for example, in the form of a metal coating, a more or less loosely adhered deposit of particles, particles in loose but intimately mixed association with the ceramic particles, or the like. In certain embodiments, the ductile metal content in the metal rich matrix phase precursor is higher than the metallic content in the cermet powder.

Metallic deposits can be formed on the ceramic particles and the cermet core particle by mechanical, chemical, electrochemical, vapor deposition, agglomeration, sintering, or other conventional deposit forming procedures, as may be desired. Various processing steps carried out for the purposes of improving the integrity or other properties of the cermet particle or the components thereof, such as cleaning, activating, pre-coating, or the like, can be employed, if desired. The metal rich matrix phase precursor can be formed on the cermet core particle in one or several sequential operations to deposit the same or different such precursor materials under the same or different conditions.

What have been described are preferred embodiments in which modifications and changes may be made without departing from the spirit and scope of the accompanying claims. Many modifications and variations of the present invention are possible in light of the above teachings. It is therefore to be understood that, within the scope of the appended claims, the invention may be practiced otherwise than as specifically described.

What is claimed is:

1. A composite body, said composite body being spall resistant and comprising a discontinuous cermet phase in a metal rich matrix phase, said discontinuous cermet phase including ceramic particles comprised of SiAlON and a cermet binder, said ceramic particles having a Moh's hardness of at least approximately 8, a modulus of less than approximately 46 million pounds per square inch, and an average particle size of from about 0.1 to 10 microns, said composite body having a Vicker's hardness number of greater than approximately 650, a strain to failure of at least 1 percent, and a modulus of less than approximately 46 million pounds per square inch.

2. A method of forming a composite body on a substrate comprising:

selecting a cermet particle comprising a cermet core particle including SiAlON ceramic particles, a cermet binder, and a metal rich matrix phase precursor, said metal rich matrix phase precursor comprising from about 20 to 70 volume percent of said cermet particle, said ceramic particles having a Moh's hardness of at least approximately 8, a modulus of less than approximately 46,000,000 pounds per square inch, and an average particle size of from about 0.3 to 8 microns;

injecting said cermet particle into a thermal spray generating device;

allowing said thermal spray generating device to generate a thermal spray including said cermet particle;

directing said thermal spray onto a substrate; and allowing said composite body to form a coating on said substrate that exhibits residual stresses of generally between approximately 5,000 pounds per square inch compressive and approximately 3,000 pounds per square inch tensile, and is adhered to said substrate with an adhesive strength of greater than about 10,000 pounds per square inch gauge.

* * * * *